US007576498B2

(12) United States Patent
Kobayashi

(10) Patent No.: US 7,576,498 B2
(45) Date of Patent: Aug. 18, 2009

(54) ORGANIC EL DRIVE CIRCUIT AND ORGANIC EL DISPLAY DEVICE USING THE SAME

(75) Inventor: Masato Kobayashi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 95 days.

(21) Appl. No.: 11/720,202

(22) PCT Filed: Nov. 21, 2005

(86) PCT No.: PCT/JP2005/021352

§ 371 (c)(1),
(2), (4) Date: May 25, 2007

(87) PCT Pub. No.: WO2006/057213

PCT Pub. Date: Jun. 1, 2006

(65) Prior Publication Data

US 2008/0042583 A1 Feb. 21, 2008

(30) Foreign Application Priority Data

Nov. 29, 2004 (JP) ..... 2004-343382

(51) Int. Cl.
*G05F 1/00* (2006.01)

(52) U.S. Cl. ..... 315/291; 315/307; 315/308

(58) Field of Classification Search ..... 315/291, 315/307, 308

See application file for complete search history.

(56) References Cited

U.S. PATENT DOCUMENTS

2002/0021096 A1* 2/2002 Komiya ..... 315/169.1
2003/0169220 A1* 9/2003 Tsuchiya et al. ..... 345/84
2005/0078065 A1* 4/2005 Hayafuji et al. ..... 345/76
2006/0001613 A1* 1/2006 Routley et al. ..... 345/76

FOREIGN PATENT DOCUMENTS

| | | |
|---|---|---|
| JP | 2001-143867 | 5/2001 |
| JP | 2003-332624 | 11/2003 |
| JP | 2004-6533 | 1/2004 |
| JP | 2004-085751 | 3/2004 |
| JP | 2005-3849 | 1/2005 |
| WO | 03/107318 | 12/2003 |

OTHER PUBLICATIONS

Translation of International Preliminary Examination Report for corresponding International Application No. PCT/JP2005/021352, International Filing Date: Nov. 21, 2005.

* cited by examiner

*Primary Examiner*—Douglas W Owens
*Assistant Examiner*—Jianzi Chen
(74) *Attorney, Agent, or Firm*—Brundidge & Stanger, P.C.

(57) ABSTRACT

A voltage corresponding to the maximum voltage value among respective terminal voltages at least at the time of light emission of organic EL elements is held in a hold circuit, and a power source circuit which generates electric power having a voltage higher by a predetermined value than the voltage held as a power source voltage is provided. The power source voltage is caused to follow and vary depending on the maximum voltage value among the respective terminal voltages at the time of light emission, and is determined as a power source voltage for the output stage current sources. Further, in order to permit operation of the respective output stage current sources with a difference voltage between the power source voltage and the maximum voltage value, the predetermined value is set at the difference voltage or a voltage higher than the difference voltage.

10 Claims, 4 Drawing Sheets

ORGANIC EL DRIVE CIRCUIT AND ORGANIC EL DISPLAY DEVICE USING THE SAME

FIELD OF THE INVENTION

The present invention relates to an organic EL drive circuit and an organic EL display device using the same and, more specifically, relates to an improvement for an organic EL drive circuit and an organic EL display device which permit to reduce the power consumption in the organic EL display device by decreasing the power consumption in an output stage current source therein.

BACKGROUND ART

Recently, the number of drive pins for an organic EL display device tends to be increased according to a demand of further higher resolution. For this reason, the drive frequency thereof is raised and the power consumption tends to be increased.

Since number of pins for a QVGA full color in an organic EL display device now under development reaches 360 wherein 120 pins respectively for R, G and B, three drivers therefor are now necessitated. Such an increase of the terminal pin number increases power consumption in a column driver IC. Therefore, reduction of the power consumption is demanded.

Now a technology in which organic EL elements are current driven with low power consumption by making use of a DC/DC converter is known (patent document 1).

Patent document 1: JP-2001-143867A

On the other hand, noting difference in light emission efficiency for R, G and B, the present applicant invented the following technology and has filed as Japanese patent application No. 2003-166067 titled "Organic El drive circuit and organic EL display device using the same".

In the invention, through respective provision of a first power source line having a high voltage and a second power source line having a lower voltage than that of the first power source line depending on the light emission efficiency of organic EL elements for R, G and B, current source voltages for driving the organic EL elements for R, G and B are made different. Then, the organic EL elements having higher light emission efficiency are assigned to the second power source line of which electric power is supplied from the first power source line for the organic El elements having lower light emission efficiency via a switching regulator and with the switching regulator the voltage of the second power source line is stabilized at a predetermined voltage.

SUMMARY OF THE INVENTION

Tasks to be Solved by the Invention

Since the invention disclosed in Japanese patent application No. 2003-166067 necessitates in addition to the DC/DC converter the separate switching regulator and the like as the power source circuit, the invention causes a problem to increase the number of ICs, when the organic EL drive circuit is formed into ICs.

Further, since the invention disclosed in Japanese patent application No. 2003-166067 stabilizes the power source voltage at the output side as a constant voltage by obtaining the difference in voltage between the first power source line and the second power source line as a constant voltage, when the display brightness is low, a voltage drop component from the power source voltage of which component is necessary at the time of low brightness causes a voltage drop at the side of the drive current source for driving the organic EL elements. When the number of the terminal pins for an organic El panel increases, the power consumption by the voltage drop when the display brightness is low increases to an innegligible level.

An object of the present invention is to resolve such problems in the conventional art and to provide an organic EL drive circuit, which permits to reduce the power consumption by lowering the power consumption at the output stage current source.

Another object of the present invention is to provide an organic EL drive circuit and an organic EL display device, which permits to reduce the power consumption by lowering the power consumption at the output stage current source.

Measure for Solving the Tasks

A constitution of an organic EL drive circuit or an organic EL display device according to the present invention which achieves such objects is provided with, in the organic El drive circuit which outputs drive current in correspondence with respective terminal pins for one line component in horizontal direction at the column side of an organic El panel and current drives the organic El panel, a maximum voltage value detection circuit which detects the maximum voltage value among voltages with respect to respective drive current corresponding to the respective terminal pins of one line component in horizontal direction, a hold circuit which receives the maximum voltage value and holds a voltage corresponding to the maximum voltage value at least at the time of light emission of organic EL elements, a power source circuit which receives an input electric power and generates an electric power having a voltage higher by a predetermined value than the voltage held as a power source voltage and output stage current sources which are respectively provided for the respective terminal pins, operated when received the power source voltage and generate the drive current, wherein the predetermined value is set at equal to or more than a voltage with which the output stage current sources can current drive the organic EL elements.

Advantages of the Invention

In the present invention as explained above, the hold circuit which holds a voltage corresponding to the maximum voltage value among the respective terminal voltages at least at the time of light emission of the organic EL elements is provided, the voltage is held in the hold circuit and the power source circuit which generates an electric power having a voltage higher by a predetermined value than the voltage held as a power source voltage is provided. With these circuits, the power source voltage is caused to follow and vary depending on the maximum voltage value among the respective terminal voltages at the time of light emission of the organic EL elements. The power source voltage is determined as the power source voltage for the output stage current sources. Further, in order to permit operation of the respective output stage current sources with the difference voltage between the power source voltage of this power source and the maximum voltage value, the predetermined value is set at the difference voltage or a voltage higher than the difference voltage.

With this measure, since the respective output stage current sources generate the drive current in a range of the difference voltage, a voltage drop at the respective output stage current sources is suppressed and the power consumed therein can be reduced.

As a result, provision of a plurality of power source circuits such as the switching regulator in addition to the DC/DC converter is avoided and the power consumption in the organic EL drive circuit and the organic EL display device can be reduced.

BEST MODES FOR CARRYING OUT THE INVENTION

FIG. 1 is a block diagram primarily of a power source circuit including a voltage control circuit for an organic EL panel according to an embodiment in which an organic EL drive circuit of the present invention is applied, FIG. 2 is a view for explaining primarily of a concrete example of a maximum voltage value detection circuit and a peak hold circuit in the embodiment of FIG. 1, FIG. 3 is a view for explaining a control of the power source voltage and drive waveforms for terminal pins and FIG. 4 is a view for explaining an example of a step-up type switching regulator in an embodiment which uses a step-up type switching regulator.

In FIG. 1, numeral 10 is a column IC driver (herein below will be called as a column driver) as an organic EL drive circuit in an organic EL panel and 1 is a DC/DC converter for supplying an electric power to the column driver 10. The DC/DC converter 1, for example, receives an electric power (for example, the voltage thereof is 3.5V) from a battery 9 via an input terminal Vin, steps up at a step-up circuit 1*e* and generates an electric power having a DC voltage of 24V. The electric power is applied to a step down type switching regulator wherein the voltage is lowered and a constant voltage in a range of about 6V~22V is generated at the output terminal Vout. The electric power is output from the output terminal Vout to a power source line 11 (+Vcc) in the column driver 10. The voltage output to the power source line 11 is herein follow up controlled by a power source voltage control circuit 2 depending on light emission brightness of organic EL elements and is varied in a range of about 6V~22V.

Further, the step-up circuit 1*e* is operated by the electric power from the battery 9 and when receives a drive pulse from a controller 12, generates an electric power having a DC voltage of 24V stepped up from the voltage of the battery 9.

The power source voltage control circuit 2 includes a maximum voltage value detection circuit (this circuit is provided inside the column driver 10) 3 which respectively receives terminal voltages at output terminal 10*a*, 10*b*, . . . 10*n* at the column side for horizontal one line component in the column driver 10 and detects the maximum voltage value among them. The power source voltage control circuit 2 is further provided with a peak hold circuit 4 which holds the maximum voltage value detected by the maximum voltage value detection circuit 3, a discharge circuit 5 and a clamp voltage generation circuit 6. Further, in the present embodiment, for the sake of easy explanation, although the column driver 10 including output terminals for horizontal one line component is explained as a single IC, the column driver 10 can be a plurality of ICs.

The DC/DC converter 1 is constituted by the step-up circuit 1*e*, the step down type switching regulator, which stabilizes the voltage stepped up at the step-up circuit 1*e* and an output voltage detection circuit 8. The step down type switching regulator is constituted by an error amplifier 1*a*, a PWM pulse drive circuit 1*b*, a P channel switching MOS transistor 1*c* and a stabilizing circuit (constituted by a coil L, a fly wheel diode D and a capacitor C) 1*d* for the stepped up voltage. The output power of the DC/DC converter 1 is output to the power source line 11 as an output power source voltage value Vo via the stabilizing circuit 1*d*.

The error amplifier 1*a* compares a detection voltage of the output voltage detection circuit 8 with a voltage sent out from the power source voltage control circuit 2 and generates an error signal (usually a voltage signal).

The PWM pulse drive circuit 1*b* receives signals of triangle wave from the control circuit 12, slices the triangle wave depending on the error signal (voltage signal) and produces a PWM pulse having a duty ratio in a direction of eliminating the error.

Further, the PWM pulse drive circuit 1*b* receives the electric power from the power source line of which voltage is stepped up by the step-up circuit 1*e*. Further, the signal of triangle wave can be produced inside the PWM pulse drive circuit 1*b* by receiving such as clocks CLK from the control circuit 12.

The switching MOS transistor 1*c* receives PWM pulses from the PWM pulse drive circuit 1*b* and is switched in response thereto to supply an electric power having a predetermined voltage to the stabilizing circuit 1*d*.

The maximum voltage value detection circuit 3 is a circuit having a high input impedance which detects the maximum voltage among the respective voltages with respect to the respective drive currents at the output terminals 10*a*~10*n* and performs the voltage detection operation without affecting the current output operation at the output terminal 10*a*~10*n*.

The voltage value (maximum terminal voltage value) Vm detected by the maximum voltage value detection circuit 3 is input to the peak hold circuit 4 and held therein. The voltage value Vm held in the peak hold circuit 4 is input to (−) input side of the error amplifier 1*a* in the DC/DC converter 1 as a comparison reference voltage and is compared with the detection voltage from the output voltage detection circuit 8.

The detection voltage of the output voltage detection circuit 8 is a level shift circuit constituted by a series circuit of three diodes D1, D2 and D3 and a resistor R provided between the output terminal Vout and the ground GND, and a voltage at the connection point N between the diode D3 and the resistor R is taken out as the detection voltage. Thereby, the detection voltage is generated from the output power source voltage value Vo via the three diodes as a voltage level shifted in lowering direction by Δ V and is input to (+) input side of the error amplifier 1*a* as a target voltage value (Vo)−3Vf (wherein Vf=0.7V, voltage drop in forward direction of the diode).

As a result, the PWM pulse drive circuit 1*b* generates PWM modulated drive pulses in response to the error output of the error amplifier 1*a* and ON/OFF controls the switching transistor 1*c* so that the output power source voltage value Vo is controlled to assume the voltage value of Vm+3Vf.

Thereby, the power source voltage+Vcc (voltage value Vo) gives a voltage which follows the terminal voltage at the column side corresponding to an organic EL element 14 generating the maximum brightness as display brightness among one horizontal line at the moment in every vertical scanning among the voltages of the terminal voltages at the column side for horizontal one line component. An electric power of such a voltage as the power source voltage+Vcc (voltage value Vo) is generated and supplied to the power source line and then supplied to respective output stage current sources 7*a*~7*n* in the column driver 10.

Herein, 3Vf=Δ V (=2.1V) is a bias voltage with respect to the respective output stage current sources 7*a*~7*n* which is required when the respective output stage current sources 7*a*~7*n* produce with respect to the respective output terminals

10*a*~10*n* constant drive currents from a predetermined minimum brightness to a predetermined maximum brightness in connection with display brightness for the organic EL elements 14. The bias voltage Δ V guarantees with respect to a clamp voltage VCL which will be explained below a generation of the output power source voltage value Vo of VCL+Δ V or more. The bias voltage Δ V gives a difference voltage which causes the output power source voltage value Vo to follow to the maximum voltage among the respective terminal voltages with respect to the drive currents.

Thus, the respective output stage current sources 7*a*~7*n* can generate at the respective output terminals 10*a*~10*n* the drive current depending on display data regardless to the variation of the output power source voltage value Vo when the operation voltage of difference Δ V is received. Further, at this moment, a variation range of the output power source voltage value Vo is in clamp voltage VCL+Δ V <=Vo <=Vmax+Δ V. Wherein Vmax is the maximum voltage among the terminal voltages at the output terminals 10*a*~10*n* when the organic EL elements 14 are driven with the constant current which causes the maximum brightness as the display brightness (see FIG. 3(*c*)). The maximum voltage is, for example, Vo=about 22V.

The discharge circuit 5 slowly discharges the voltage value Vm held in the peak hold circuit 4 with a long time constant. The discharge circuit 5 is a constant current discharge circuit with a large discharge time constant discharging minute current.

The clamp voltage generation circuit 6 generates a clamp voltage VCL. The clamp voltage VCL corresponds to the minimum voltage (the maximum voltage for the minimum brightness) Vmin among the terminal voltages at the output terminals 10*a*~10*n* when the organic EL elements 14 are driven with the constant current which causes the minimum brightness as the display brightness. The minimum voltage is, for example, Vo=about 6V.

Herein, reset control pulses RS in FIG. 3(*b*) are referred to. Display time DT in FIG. 3(*b*) corresponds to the scanning period for horizontal one line and reset time RT corresponds to the retrace period for horizontal one line scanning. In the present embodiment, the voltage value Vm held in the peak hold circuit 4 is continuously held even during the scanning period for horizontal direction one line and the retrace period therefor, and the voltage held during retrace period is discharged through the discharge circuit 5.

Accordingly, the time constant of the discharge circuit 5 is set at a large time constant (see the latter half of the waveform of one dot and chain line in FIG. 3(*a*)) so that during a period (a period of reset time RT+peak current generation time PT, see FIG. 3(*b*)) after completing a certain horizontal one line scanning at an average display brightness (an intermediate value between the maximum brightness and the minimum brightness of the organic EL elements) of the organic EL elements 14 and before the organic EL elements 14 subsequently light emit by the subsequent horizontal one line scanning, a voltage drop due to discharge of the voltage value (the maximum terminal voltage value) Vm held in the previous, in other word, the certain horizontal one line scanning does not lower below the clamp voltage VCL (=Vmin), (see the latter half of one dot and chain line in FIG. 3(*a*)). Thereby, the output power source voltage value Vo is prevented to follow after dropping to the output power source voltage value Vo=VCL+Δ V which is set by the clamp voltage VCL under an average display condition.

Further, the average display brightness can be an average value of the organic EL elements based on the design data or under the use condition thereof. When the time constant of the discharge circuit 5 is set at a limit value wherein the output power source voltage value drops to the clamp voltage VCL in the period before the organic EL elements 14 subsequently light emit in the average display brightness, the power source voltage control circuit 2 generates with the clamp voltage generation circuit 6 the clamp voltage VCL and clamps the output power source voltage value Vo. As a result, the output power source voltage value Vo drops to power source voltage+Vcc corresponding to clamp voltage VCL+Δ V. The output power source voltage value Vo thereafter follows the output terminal voltage raised according to the drive by the output stage current sources 7*a*~7*n*.

At the time of closing of the power source voltage, the clamp voltage generation circuit 6 is operated when a start signal of a power on reset circuit (not shown) is received, and since the output voltage VCL of the clamp voltage generation circuit 6 is supplied to (−) input side of the error amplifier 1*a* as a reference voltage, the follow up control operation of the DC/Dc converter 1 starts from the output voltage value Vo=VCL+Δ V (=3Vf), if in case when the voltage value Vm held in the peak hold circuit 4 is less than the output voltage VCL, the reference voltage at (−) input side of the error amplifier 1*a* assumes the clamp voltage VCL, the power source voltage+Vcc (voltage value VO) of the power source line 11 output from the DC/DC converter 1 is clamped at a voltage of output voltage VCL+Δ V (=3Vf) and the output power source voltage never lowers less than the voltage.

As a result, as shown in FIG. 3(*a*), when the terminal voltage, which generates the maximum brightness as the display brightness among the column side output terminal voltages for horizontal one line component at the moment of line scanning in a certain vertical direction, is shifted in the display time DT as shown by graph A, the output power source voltage value Vo to the power source line 11 follows with a voltage more than Δ V=2.1V as given by a graph shown by one dot and chain line.

Further, in FIGS. 3(*a*)~(*c*), the ordinate is voltage and the abscissa is time. ST is start time at the time of power source closing and is a period for generating the output power source voltage value Vo by the output voltage VCL from the clamp voltage generation circuit 6. DT is a display time wherein the organic EL elements 14 are light emitting and RT is a reset time.

As shown in FIG. 3(*a*), when the brightness of the organic EL elements 14 varies from a high brightness to a low brightness, the maximum brightness of an organic EL element which shows the maximum light emission brightness among many numbers of organic EL elements in a horizontal one line during scanning reduces. At this moment, the voltage value Vm held in the peak hold circuit 4 in response to the time constant of the discharge circuit 5 reduces according to the scanning for the horizontal line (see the latter half of one dot and chain line in FIG. 3 (*a*)). Thus, the voltage reduction of the power source voltage+Vcc (voltage value Vo) slowly follows the variation. Contrary, when the brightness of the organic EL elements 14 varies from a low brightness to a high brightness, since the maximum brightness of a certain organic EL element in a horizontal one line during scanning rises, the power source voltage+Vcc (voltage value Vo) rapidly follows in response to the varying voltage (see the last waveform of one dot and chain line in FIG. 3(*a*)).

Further, in this moment, the power source voltage value Vo level shifted by Δ V can be adjustable by number of diodes, and in a case of a zener diode, the necessary voltage value Δ V can be ensured by a single zener diode. Further, when the internal impedance of the output stage current sources in the column driver 10 is low and the drive capacity thereof is large, a difference voltage Δ V of about 0.7V, a component of a single diode, is theoretically possible for the required following, which depends on the current drive capacity (ON resistance) for the organic EL elements 14, when the respective output stage current sources 7*a*~7*n* are turned ON.

FIG. 2 is a view for explaining primarily of a concrete example of the maximum voltage value detection circuit 3 and the peak hold circuit 4. For the sake of easy explanation, although a case of four output terminals is shown, actually, the number of the output terminals is more than 100. In a case when the column driver is constituted by a plurality of ICs, the maximum voltage value detection circuit 3 can be provided for the respective ICs. In this instance, further maximum voltage value is detected between the maximum voltage value detection circuits 3 for the plurality of ICs.

The maximum voltage value detection circuit 3 is constituted by input stage transistors of N channel MOS transistors Qa~Qd which are respectively connected to the output terminals 10*a*~10*d* and a diode connected N channel MOS transistor Qo of which source is connected in common to the respective sources of these output stage transistors. The drain sides of the respective transistors Qa~Qd are respectively connected to the power source line +VDD of the battery 9, and the drain of the transistor Qo is connected to the power source line +VDD via a constant current source 21 of current value I. Further, in FIG. 2 illustration, the connection of such as the maximum voltage value detection circuit 3 and the peak hold circuit 4 with the battery 9 is omitted.

Between a common source to which the respective sources of the respective transistors Qa~Qd and of the diode connected transistor Qo are connected in common and the ground GND, a constant current source 22 of current value 2×I is provided. Further, the drain of the transistor Qo is connected to an output terminal 23 where the detection voltage with respect to the maximum voltage value is generated, and the generated voltage is output to the peak hold circuit 4.

The peak hold circuit 4 is constituted by an operational amplifier (OP) 41, a diode 43, a capacitor 42 and a voltage follower 44. The output of the operational amplifier (OP) is fed back to (−) input side (an inverted input terminal) thereof via the diode 42 and the (+) input (non-inverted input terminal) thereof is connected to the output terminal 23 of the maximum voltage value detection circuit 3. Thereby, the (+) input assumes a high impedance input and the output terminal 23 gives a voltage output.

Further, as the discharge circuit 5, a discharge resistor Rd connected in parallel with the capacitor 43 is provided in this concrete example.

Herein, since the input impedance of the operational amplifier (OP) with respect to the output terminal 23 of the maximum voltage value detection circuit 3 shows high, the output terminal 23 gives substantially a voltage output and with respect to the common source side of the transistors Qa~Qd in the maximum voltage value detection circuit 3, only one having the highest gate voltage is turned ON.

Namely, the common source side of the transistors Qa~Qd is set in such a manner that any of the transistors Qa~Qd can move to an ON state depending on the bias relation with the constant current source 22, and when one transistor among them having a high gate voltage is turned ON, since the common source voltage is thereby shifted up with a lower value by 1Vf, the source voltage of the other transistors rise to turn OFF the other transistors having a lower gate voltage. As a result, among the transistors Qa~Qd, only a transistor to which gate the maximum terminal voltage is applied is turned ON, and a voltage depending on the gate voltage is generated at the source side and detected.

On the other hand, the constant current source 22 receives current of current value I from the up-steam from the constant current source 21 via the diode connected transistor Qo. Accordingly, the turned ON one transistor among the transistors Qa~Qd receives the remaining current of I. At this moment, since the common source of the transistors Qa~Qd assumes the lower voltage by 1Vf from the maximum terminal voltage among the output terminals 10*a*~10*n*, the output terminal 23 connected to the drain of the diode connected transistor Qo assumes a higher voltage by 1Vf than that of the common source and the maximum terminal voltage value among those at the output terminals 10*a*~10*n* is output at the output terminal 23.

DZ is a zener diode and a reset voltage VR (see the pin drive/voltage current of FIG. 3(*b*)) corresponds thereto. Switches SW receive reset control pulses RS as shown in FIG. 3(*b*) and are turned ON when the pulses are "H" (HIGH level). As a result, at the output terminals 10*a*~10*n*, the pin drive voltage/current of FIG. 3(*b*) is generated. A solid line represents the output voltage waveform and a dotted line represents the drive current waveform.

Further, FIG. 3(*c*) shows peak generation pulses Pp and PT as shown in FIG. 3(*b*) corresponds to a peak current generation time. The reset control pulses RS and the peak generation pulses Pp are supplied from the control circuit 12 as shown in FIG. 1. Numeral 13 is a row side scanning circuit and performs a row side line scanning (vertical direction scanning for one horizontal line) when pulses such as the reset control pulses RS and row scan pulses RSTP are received.

The voltage waveform and the pin drive voltage/current of FIG. 3(*b*) vary depending on display data for the brightness display and depending on the variation the light emission brightness of the organic EL elements 14 varies. According thereto, the terminal voltages of the organic EL elements 14 vary. FIG. 3(*c*) shows such state.

The maximum voltage value (=held voltage value) Vm detected by the maximum voltage value detection circuit 3 charges the capacitor 43 via the diode 42 and held therein and the voltage is input as a reference voltage to (−) input side of the error amplifier 1*a* via the voltage follower 44.

As a result, the output power source voltage value Vo varies depending on the maximum terminal voltage value of the organic EL elements 14 and the voltage +Vcc of the power source line 11 varies from VCL+ΔV (Vmin+ΔV) to Vmax+ΔV in a relationship as shown in FIG. 3(*c*). In this instance, ΔV serves as the operation voltage for the output stage current sources 7*a*~7*d*.

Thus, during a certain horizontal scanning period (light emission period), the light emission brightness showing the maximum reduces and when the maximum terminal voltage value detected by the maximum voltage value detection circuit 3 reduces, the held voltage value Vm reduces according to the time constant determined by the capacitor 43 and the discharge resistor Rd and gradually follows the reduced maximum voltage value among the terminal voltages at the respective output terminals. In the opposite instance, since the voltage value Vm held in the peak hold circuit 4 instantly reduces, the voltage of the power source voltage+Vcc follows in response to the control speed of the DC/Dc converter 1.

The DC/DC converter 1 in FIG. 1 embodiment performs follow up control of the output power source voltage value Vo with the step-up circuit 1*e* and the step down type switching regulator. However, in place of such constitution, a single step-up type switching regulator can be used. FIG. 4 is an example of such step-up type switching regulator 11*a*.

In FIG. 4, the step-up circuit 1*e* and the diode D in FIG. 1 are eliminated and a diode Da is inserted between the coil L and the capacitor C. The P channel switching MOS transistor 1*c* in FIG. 1 is replaced by an N channel MOS transistor 1*f*, and the N channel switching MOS transistor if is provided between a connection point Na of the coil L and the diode Da and the ground GND. The other terminal of the coil L is connected to the positive terminal of the battery 9 via Vin. Since the other constitution is like one in FIG. 1, the detailed explanation thereof is omitted.

Further, since the battery 9 serves as the power source for the PWM pulse drive circuit 1*b*, the power source voltage is low. Therefore, the voltage of the battery 9 is desired to be high as much as possible.

INDUSTRIAL APPLICABILITY

As has been explained hitherto, in the present invention, when a plurality of driver ICs are use for the terminals of the organic EL panel at the column side for a horizontal one line component, the horizontal one line component is allotted to the plurality of driver ICs. Therefore, the maximum voltage value detection circuit is further required to choose the maximum value among the detection voltages from these ICs. In this instance, the peak hold circuit is to obtain the maximum voltage value among the terminal voltages of the respective output terminals from the respective driver ICs via a logical OR circuit of diodes.

Further, in this instance, the maximum voltage value detection circuit can be provided at the outside of the respective driver ICs. In this instance the maximum value can be detected by receiving the terminal voltages from the plurality of ICs without routing the logical OR circuit of diodes.

Although the present embodiment is constituted in such a manner that through provision of the peak hold circuit, the maximum terminal voltage value (held voltage value) Vm is discharged with a large time constant, in the present invention, instead of the peak hold circuit, a hold circuit which simply holds the voltage of the maximum terminal voltage value Vm can be provided. In this instance, such hold circuit can hold every horizontal one line scanning a voltage at a timing when the light emission from the organic EL elements stabilizes after generating a peak current among drive currents of the organic EL elements. Wherein the latest maximum voltage value Vm held in every horizontal one line scanning is reset and a new maximum voltage value Vm is updated and held.

Further, the difference voltage $\Delta V$ for causing to follow the power source voltage is sufficient if the value thereof shows a predetermined potential difference which permits operation of the output stage current sources with respect to the maximum terminal voltage value at the output terminals.

EXPLANATION OF REFERENCE NUMBERS

Figure 1:
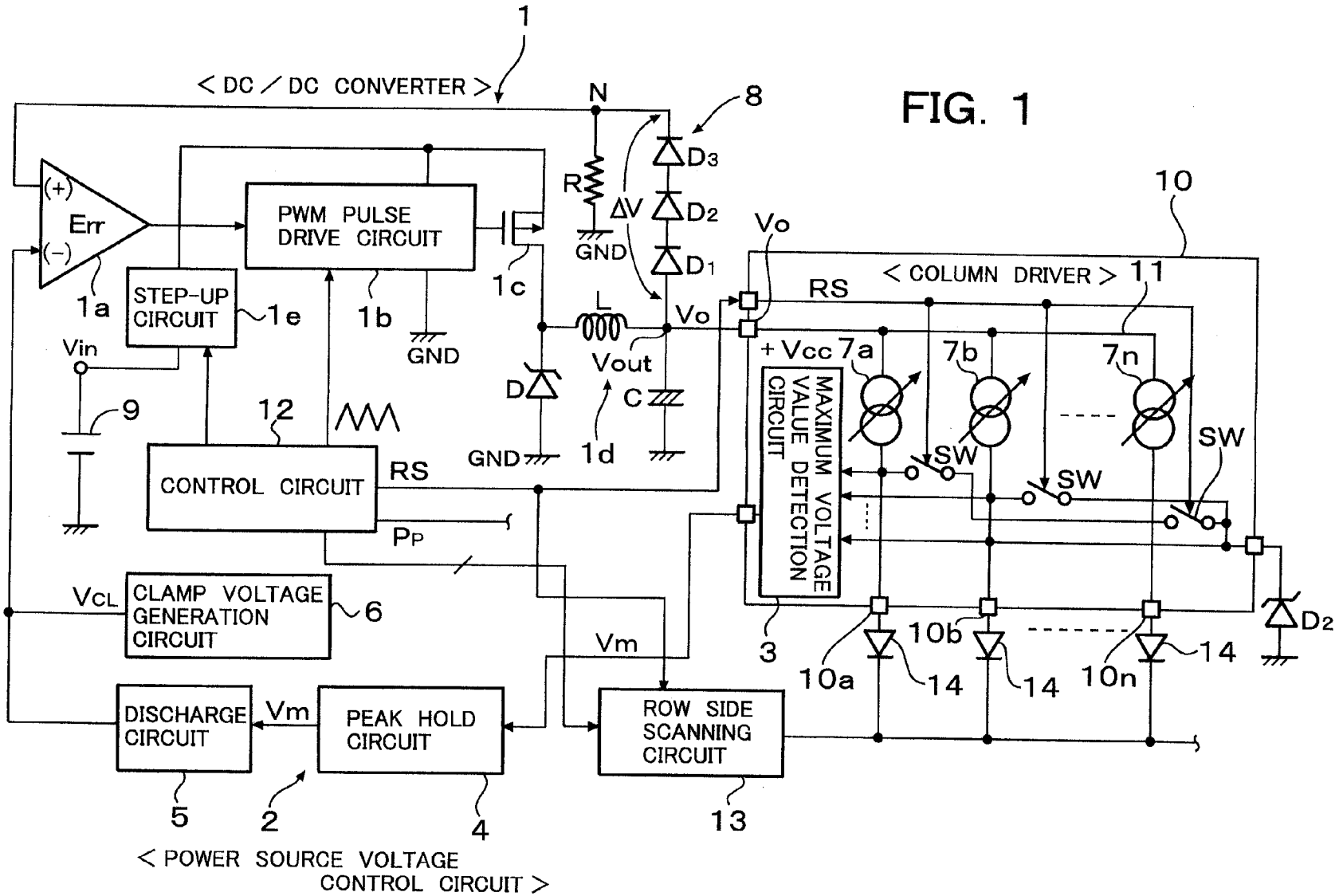
FIG. 1 is a block diagram primarily of a power source circuit including a voltage control circuit for an organic EL panel according to an embodiment in which an organic EL drive circuit of the present invention is applied.
Figure 2:
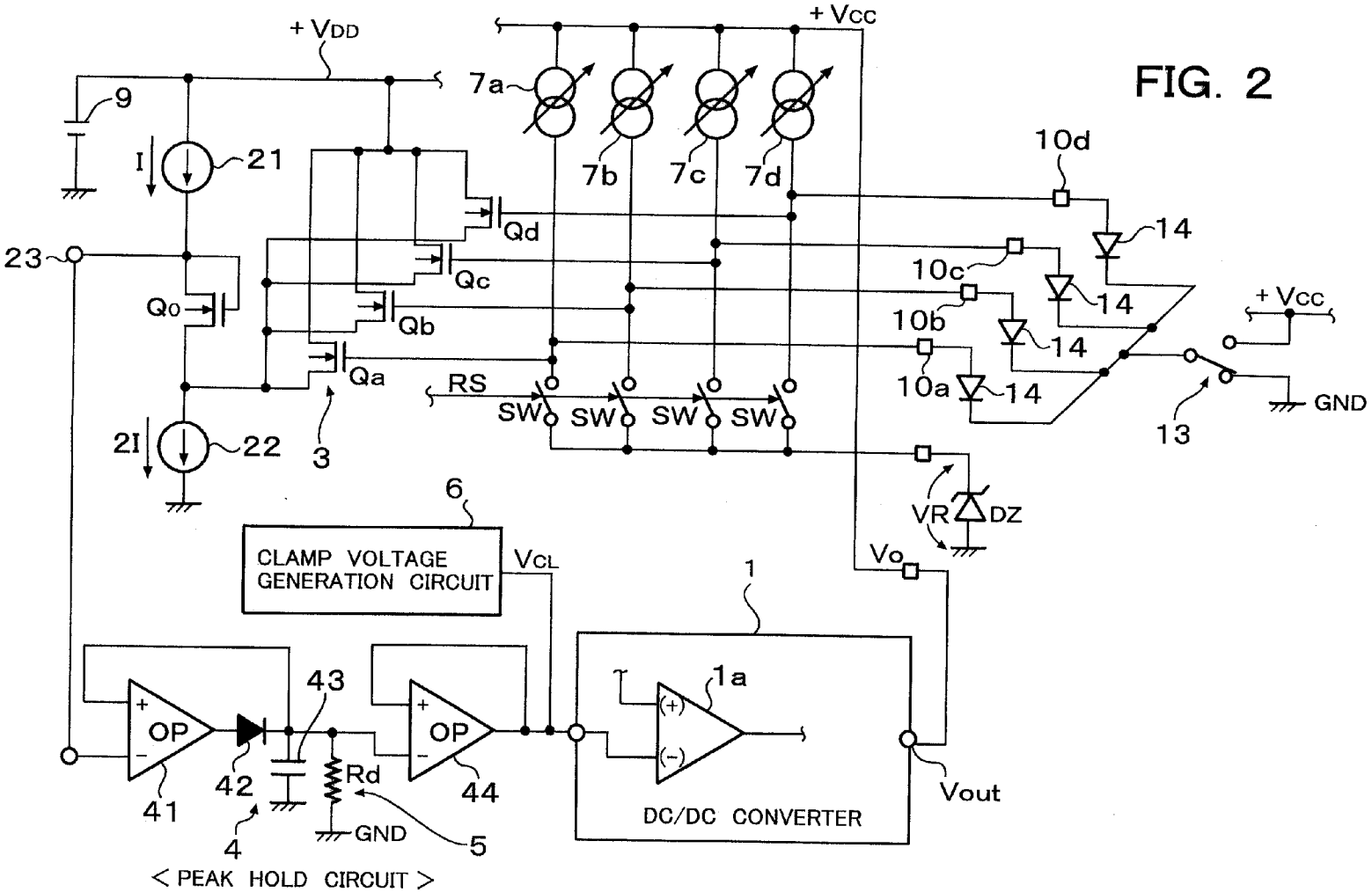
FIG. 2 is a view for explaining primarily of a concrete example of a maximum voltage value detection circuit and a peak hold circuit in the embodiment of FIG. 1.
Figure 3A:
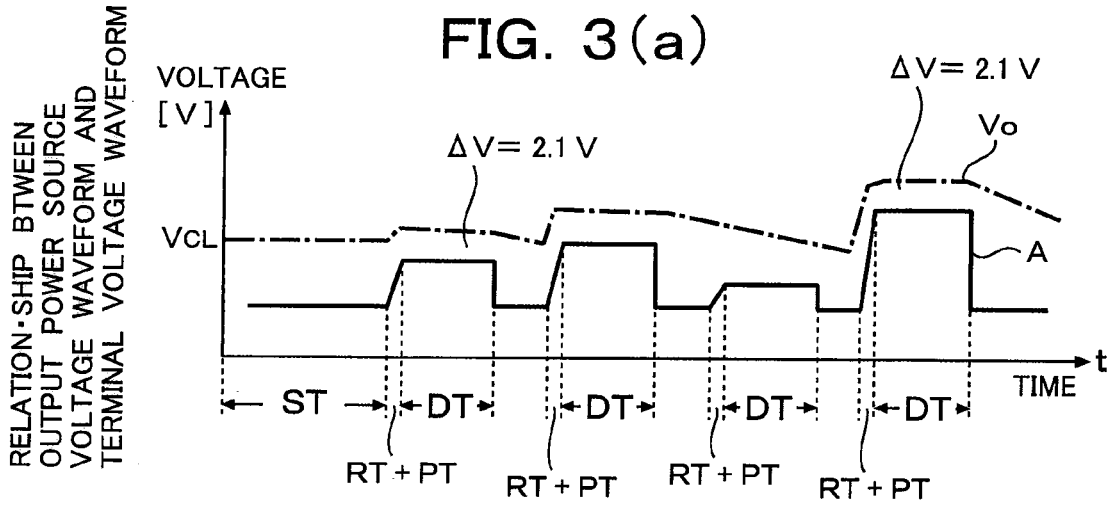
FIG. 3(*a*) is a view or explaining a relationship between an output power source and a terminal voltage, FIG. 3(*b*) is a view for explaining a relationship among a reset control pulse, a peak generation pulse and a pin drive voltage/current, and FIG. 3(*c*) is a view for explaining a variation range of output voltage.
Figure 3B:
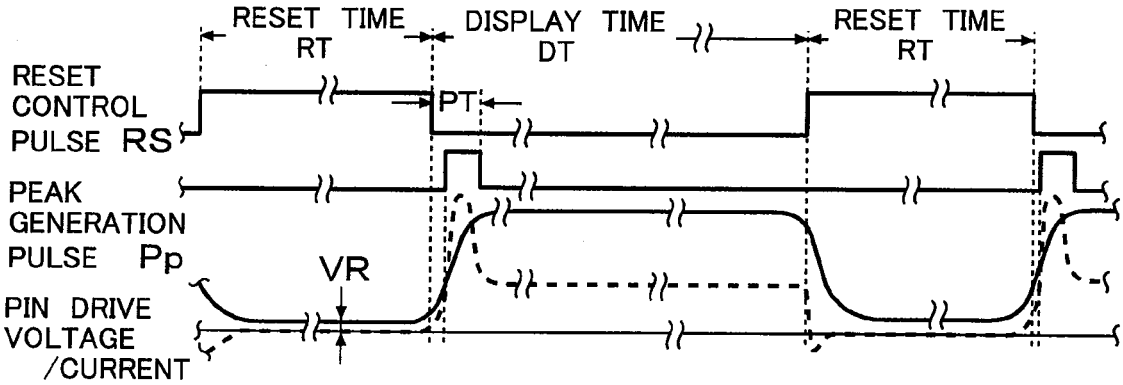
Figure 3C:
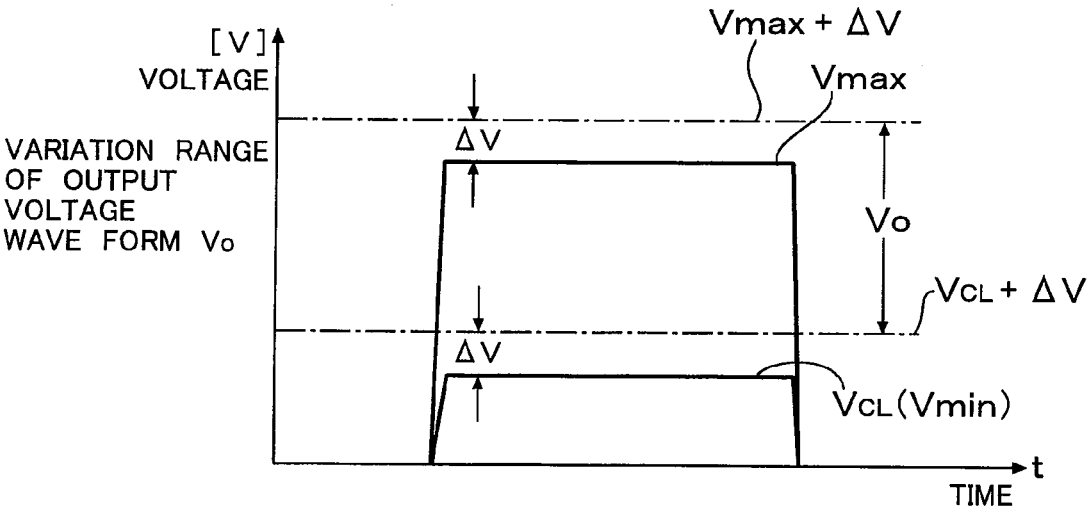
Figure 4:
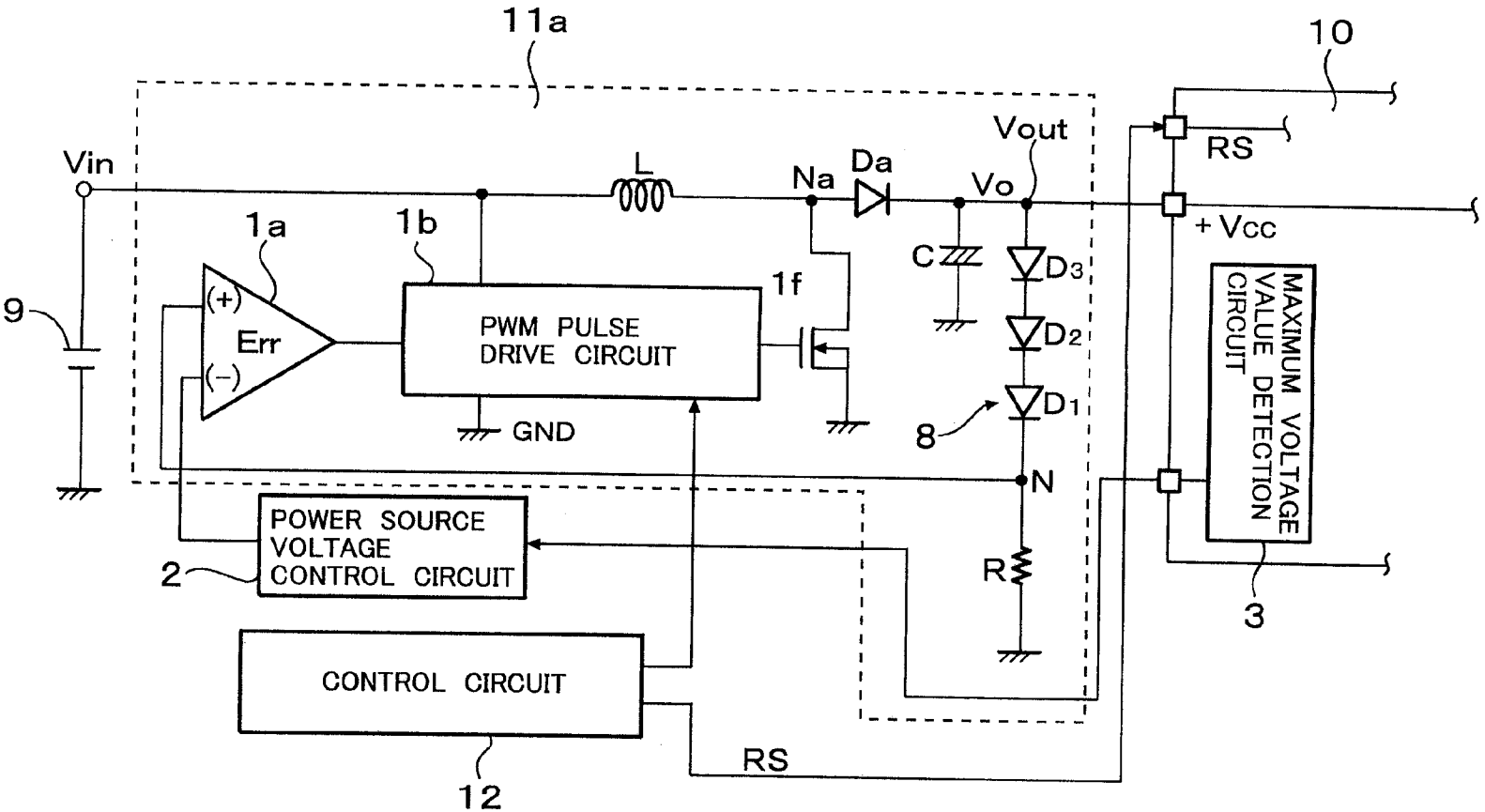
FIG. 4 is a view for explaining an example of a step-up type switching regulator in an embodiment, which uses a step-up type switching regulator.

1 . . . DC/DC converter,
1*a* . . . Error amplifier,
1*b* . . . PWM pulse drive circuit,
1*c* . . . Switching transistor,
1*d* . . . Step up voltage stabilizing circuit
2 . . . Power source voltage control circuit,
3 . . . Maximum voltage value detection circuit,
4 . . . Peak hold circuit,
5 . . . Discharge circuit,
6 . . . Clamp voltage generation circuit,
7*a*~7*n* . . . Output stage current source,
8 . . . Output voltage detection circuit,
9 . . . Battery,
10 . . . Column driver,
10*a*~10*n* . . . Output terminal of output stage current source
11 . . . Power source line,
12 . . . Control circuit,
13 . . . Row side scanning circuit,
14 . . . Organic EL element.

The invention claimed is:

1. An organic El drive circuit which outputs drive current in correspondence with respective terminal pins for one line component in horizontal direction at the column side of an organic El panel and current drives the organic El panel comprising:

a maximum voltage value detection circuit which detects the maximum voltage value among voltages with respect to respective drive current corresponding to the respective terminal pins of one line component in horizontal direction, a hold circuit which receives the maximum voltage value and holds a voltage corresponding to the maximum voltage value at least at the time of light emission of organic EL elements, a power source circuit which receives an input electric power and generates an electric power having a voltage higher by a predetermined value than the voltage held as a power source voltage and output stage current sources which are respectively provided for the respective terminal pins, are operated when received the power source voltage and generate the drive current, wherein the predetermined value is set at a voltage equal to or more than the voltage with which the output stage current source can current drive the organic EL elements, and wherein the predetermined value corresponds to a voltage which is necessary when the output stage current sources generate the drive current in a range from a predetermined minimum brightness to maximum brightness of the organic EL elements.

2. An organic EL drive circuit according to claim 1, wherein the maximum voltage value detection circuit includes many input terminals which are respectively connected to output terminals of the respective output stage current sources and the respective many input terminals have a high input impedance.

3. An organic EL drive circuit according to claim 2, wherein the power source circuit includes a switching regulator which receives an electric power from a battery and generates an output voltage obtained by stepping up the voltage of the received electric power to a predetermined voltage and an output voltage detection circuit which generates a lower voltage by the predetermined value than the power source voltage, and generates an electric power for the power source voltage in response to a detection voltage of the output voltage detection circuit.

4. An organic EL drive circuit according to claim 3, wherein the hold circuit continuously holds the voltage in a scanning period for a horizontal direction one line and even in the retrace period therefor, and discharges the held voltage in the retrace period.

5. An organic EL drive circuit according to claim 4, wherein the hold circuit is a peak hold circuit and further includes a time constant circuit which causes to discharge the voltage held by the peak hold circuit, the time constant thereof is selected at a value so that during a period after completing a certain horizontal one line scanning at an average display brightness of the organic EL elements and before the organic EL elements light emit by the subsequent horizontal one line scanning, a voltage drop due to discharge of the maximum voltage value held in the certain horizontal one line scanning is equal to the maximum voltage of the terminal pins corresponding to the minimum brightness level or does not drop below the voltage.

6. An organic EL drive circuit according to claim 5, wherein the switching regulator includes an error amplifier and a switching transistor, wherein the error amplifier generates an error signal between the voltage held and the detected voltage and the switching transistor performs switching in response to the error signal.

7. An organic EL drive circuit according to claim 3, wherein the voltage held in the hold circuit is held after generating a peak current in the drive current of the organic EL elements and renewed.

8. An organic EL drive circuit according to claim 4, wherein the maximum voltage value detection circuit includes many MOS transistors which are provided correspondingly to the terminal pins for the horizontal direction one line component, the gates of these MOS transistors are respectively connected to the terminal pins and the maximum voltage value is detected based on a logical OR output at the source sides of these MOS transistors.

9. An organic EL drive circuit according to claim 8, further comprising a clamp voltage generation circuit which generates the maximum voltage at the respective terminal pins corresponding to the minimum brightness level as a clamp voltage, wherein when the voltage held is lower than the clamp voltage, the voltage held is clamped at the clamp voltage.

10. An organic EL display device including an organic EL drive circuit according to claim 1.

* * * * *